US009630044B2

(12) United States Patent
Nelson

(10) Patent No.: US 9,630,044 B2
(45) Date of Patent: Apr. 25, 2017

(54) MULTIFUNCTION EXERCISE BELT

(71) Applicant: Carl William Nelson, Charlton, MA (US)

(72) Inventor: Carl William Nelson, Charlton, MA (US)

(73) Assignee: Carl William Nelson, Spencer, MA (US)

( * ) Notice: Subject to any disclaimer, the term of this patent is extended or adjusted under 35 U.S.C. 154(b) by 0 days.

(21) Appl. No.: 14/201,144

(22) Filed: Mar. 7, 2014

(65) Prior Publication Data

US 2014/0256519 A1 Sep. 11, 2014

Related U.S. Application Data

(60) Provisional application No. 61/774,404, filed on Mar. 7, 2013.

(51) Int. Cl.

| | |
|---|---|
| ***A63B 21/00*** | (2006.01) |
| ***A63B 21/065*** | (2006.01) |
| ***A63B 23/12*** | (2006.01) |

(52) U.S. Cl.
CPC ..... *A63B 21/065* (2013.01); *A63B 21/00061* (2013.01); *A63B 21/4009* (2015.10); *A63B 23/1218* (2013.01)

(58) Field of Classification Search
USPC ..... 482/105, 124
See application file for complete search history.

(56) References Cited

U.S. PATENT DOCUMENTS 4,984,786 A * 1/1991 Lemke et al. ..... 482/105

* cited by examiner

*Primary Examiner* — Jerome W Donnelly
(74) *Attorney, Agent, or Firm* — Daniel J. Kriegsman

(57) ABSTRACT

An exercise belt is provided. A plurality of loops attached along the length of the exercise belt. The present invention may further include a strap. The strap includes a first end that is releasably attachable to each of the plurality of loops, and a second end that is releasably attachable to each of the plurality of loops. A user may attach a weight to the strap and then attach the first end to one of the plurality of loops and the second end to one of the plurality of loops.

9 Claims, 3 Drawing Sheets

MULTIFUNCTION EXERCISE BELT

CROSS-REFERENCE TO RELATED APPLICATION

This application claims the benefit of priority of U.S. provisional application No. 61/774,404, filed Mar. 7, 2013, the contents of which are herein incorporated by reference.

BACKGROUND OF THE INVENTION

The present invention relates to an exercise belt and, more particularly, to an exercise belt that may hold various weights in multiple configurations.

Currently, weighted exercise belts are a great way to work out specific parts of the body. A user may perform many different exercises with an exercise belt. However, targeting and isolating desired muscle groups with exercise belts may not be possible due to the inability to change or control the location of the weight attached to the belt.

As can be seen, there is a need for an exercise belt that is able to target and isolate certain muscle groups.

SUMMARY OF THE INVENTION

In one aspect of the present invention, an exercise belt comprises: a body portion comprising a first end and a second end; a connector attached to at least one of the first end and the second end of the body portion, wherein the connector releasably attaches the first end and the second end together, a plurality of loops disposed along the length of the main portion; and a strap having a first end and a second end, wherein the first end of the strap and the second end of the strap are releasably attachable to each of the plurality of loops.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an exercise belt that allows weight to be added in various locations around the waist. The present invention allows a user to control the placement of the attached weight around the belt using loops, an adjustable strap, and clips, which in turn enable the user to target and isolate the target muscle groups of interest with particular exercises that were not possible before. The belt may allow weight to be added to various locations around the waist. By adjusting the location of the weight, the belt can be utilized for more exercises than any other weight belt and thus can be utilized to target and isolate more muscle groups.

Broadly, an embodiment of the present invention provides an exercise belt. A plurality of loops attached along the length of the exercise belt. The present invention may further include a strap. The strap includes a first end that is releasably attachable to each of the plurality of loops, and a second end that is releasably attachable to each of the plurality of loops. A user may attach a weight to the strap and then attach the first end to one of the plurality of loops and the second end to one of the plurality of loops.

Figure 1:
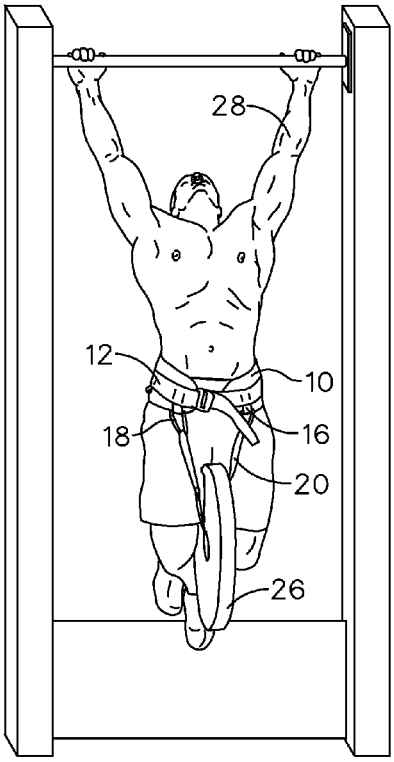
FIG. 1 is a perspective view of the present invention shown in use.
Figure 2:
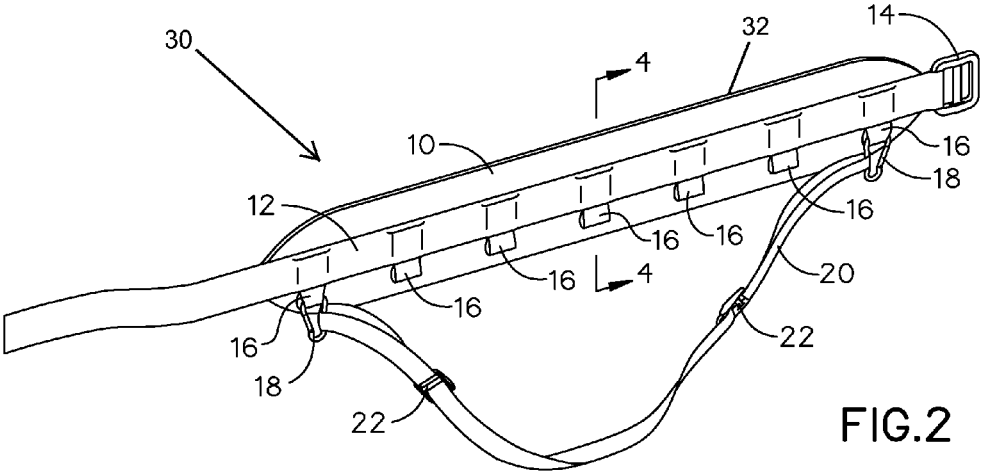
FIG. 2 is a perspective view of the present invention.
Figure 3:
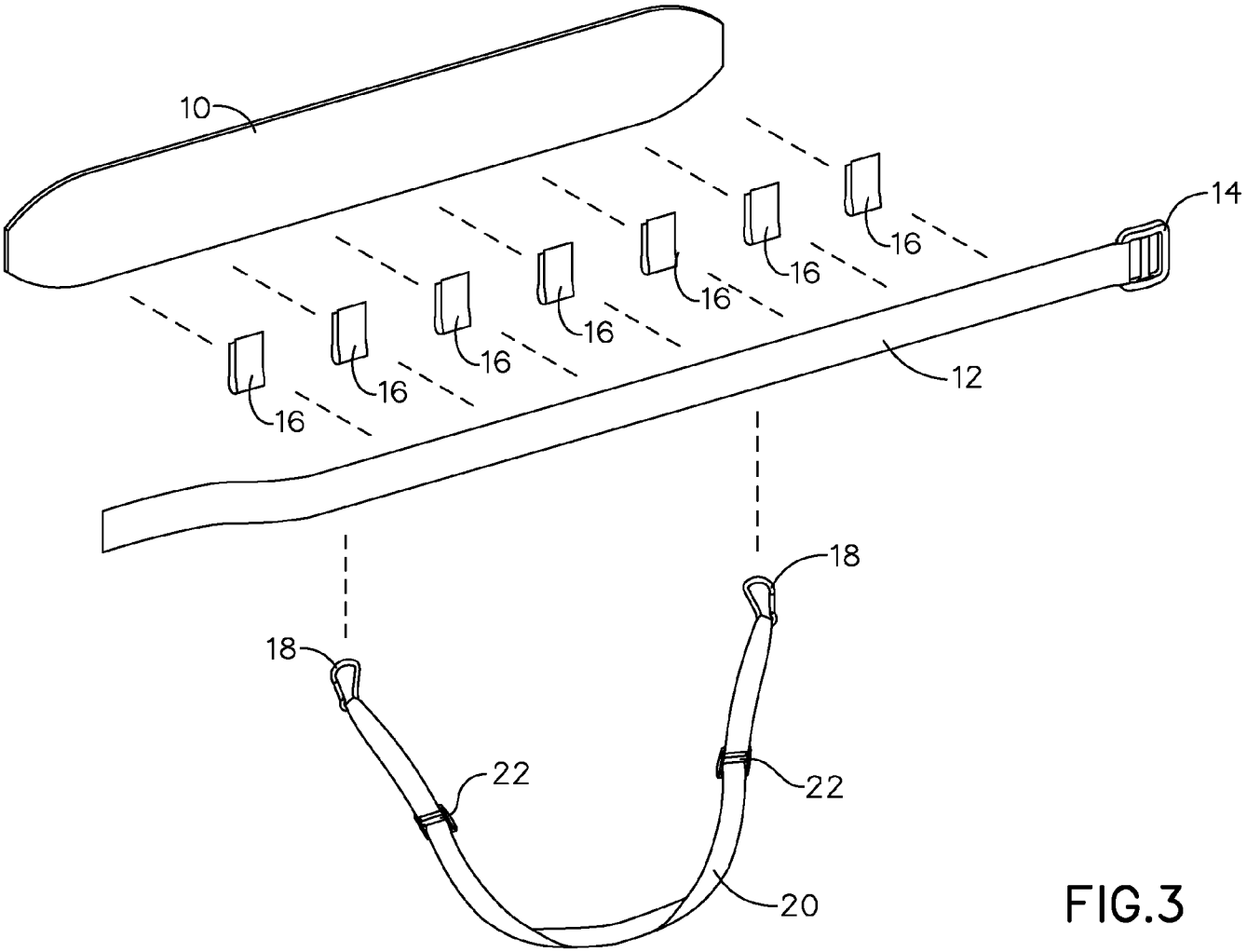
FIG. 3 is an exploded view of the present invention.
Figure 4:
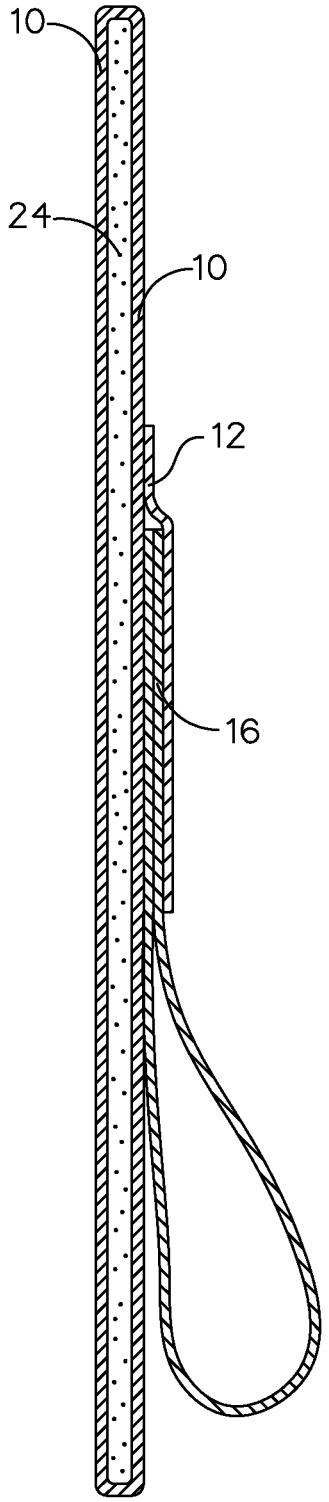
FIG. 4 is a section view of the present invention taken along line 4-4 in FIG. 2 with components removed for clarity.

Referring now to FIGS. 1 through 4, the present invention may include an exercise belt 30. The exercise belt 30 may include a body portion 32 having a first end and a second end. The present invention may further include a connector 14 attached to at least one of the first end and the second end of the body portion 32. The connector 14 releasably attaches the first end and the second end of the body portion 32 together. The present invention may further include a plurality of loops 16 disposed along the length of the body portion 32. The plurality of loops 16 may be more than 2 loops. A strap 20 may include a first end and a second end which may releasably attach to the plurality of loops 16.

In certain embodiments, the body portion 32 may include a padded layer 10 with a padding 24 within. The body portion 32 may further include belt band 12, such as belt webbing, attached to the padded layer 10. The belt band 12 may be stitched to the padded fabric 10 using thread. In certain embodiments, the connector 14 may include a buckle attached to the belt band 12. The belt band 12 may be longer than the padded layer 10 as it may be used to tighten the exercise belt 30 around the user's 28 waist using the buckle. In such embodiments, the belt band 12 may vary in length.

The plurality of loops 16 may be spaced evenly along the length of the body portion 32 of the exercise belt 30. The plurality of loops 16 may include more than two loops 16, more than three loops 16, and up to around at least six loops 16, such as seven loops 16. The plurality of loops 16 may be sandwiched between the padded layer 10 and the belt band 12. The loops 16 may be stitched to the body portion 32 using thread. The strap 20 may be releasably connectable to the loops 16 via clips 18. The clips 18 may be carabiners. Each carabiner clip 18 may connect to one of the fabric loops 16 along the length of the belt based on the user's preference during the exercise. The strap 20 may also be adjustable by adjustment buckles 22.

The user 28 may place the exercise belt 30 around their body and feed the belt band 12 through the buckle 14 to tighten around their waist. A carabiner clip 18 may be attached to loops 16 at one end of the adjustable strap 20. The user may then feed the strap 20 around a dumbbell or through the center hole of a barbell weight plate. The carabiner clip 18 that is hanging free may then be clipped to a loop 16. The carabiner clip 18 may be clipped onto one of the loops 16 based on the exercise being performed. For example, a user may clip a carabiner clip 18 to loops 16 close to the center of the user's waist or may clip the carabiner clip 18 closer to the side of the user's waist. The user may then proceed with performing the exercise with the added resistance.

The following is a method of making the present invention. Once the padding, belt band, strap, and thread are procured, the items may be sewn together using an appropriate sewing apparatus. One could outsource this sewing process to a specialized fabric manufacturer. The carabiner clips may be purchased together or separately. The fabric strapping may be interchanged with chain and may serve the same function. The padded fabric may also be interchanged with other materials such leather or polyester and may serve the same function. The carabiner clips may be interchanged with any type of clip. The attachment device may include any sort of attachment device, including, but not limited to, the buckle system mention above, a hook and loop fastener, an adjustable clip, and the like.

It should be understood, of course, that the foregoing relates to exemplary embodiments of the invention and that modifications may be made without departing from the spirit and scope of the invention as set forth in the following claims.

What is claimed is:

1. An exercise belt comprising:

a body portion comprising a first end and a second end;

a connector attached to at least one of the first end and the second end of the body portion, wherein the connector releasably attaches the first end and the second end together, a plurality of loops comprising at least three loops, the plurality of loops being spaced evenly along the length of the body portion; and a strap having a first end and a second end, wherein each of the first end of the strap and the second end of the strap is releasably attachable to each of the plurality of loops.

2. The exercise belt of claim 1, wherein the body portion comprises a padded layer and belt webbing attached to the padded layer.

3. The exercise belt of claim 2, wherein the connector comprises a belt buckle attached to the belt webbing.

4. The exercise belt of claim 2, wherein the belt webbing may vary in length.

5. The exercise belt of claim 1, wherein the plurality of loops comprises at least six loops.

6. The exercise belt of claim 2, wherein the plurality of loops is located between the padded layer and the belt webbing.

7. The exercise belt of claim 1, wherein the strap comprises a first clip on the first end and a second clip on the second end.

8. The exercise belt of claim 1, wherein the strap is adjustable in length.

9. The exercise belt of claim 1, further comprising a weight attached to the strap.

* * * * *